US006471736B2

(12) United States Patent
Campbell et al.

(10) Patent No.: US 6,471,736 B2
(45) Date of Patent: Oct. 29, 2002

(54) ACCESS APPARATUS FOR AN AIR TREATMENT APPLIANCE

(75) Inventors: Christopher Paul Campbell, Nashville, TN (US); Jay F. Perkins, Pickerington, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 21 days.

(21) Appl. No.: 09/739,422

(22) Filed: Dec. 18, 2000

(65) Prior Publication Data

US 2002/0073664 A1 Jun. 20, 2002

(51) Int. Cl.[7] ..... B01D 35/30; B01D 39/14

(52) U.S. Cl. ..... 55/356; 55/357; 55/471; 55/490; 55/496; 55/501; 55/511; 55/DIG. 34

(58) Field of Search ..... 55/356, 357, 471, 55/490, 497, 503, 511, 472, 473, 496, 501, 1.3–34

(56) References Cited

U.S. PATENT DOCUMENTS 5,529,593 A * 6/1996 Simmons ..... 55/354
5,753,002 A * 5/1998 Glucksman ..... 55/471
5,893,939 A * 4/1999 Rakocy et al. ..... 55/471
5,984,991 A * 11/1999 Glucksman ..... 55/471
6,001,145 A * 12/1999 Hammes ..... 55/471
6,017,375 A * 1/2000 Duell et al. ..... 55/471
6,030,426 A * 2/2000 Stopyra et al. ..... 55/471

* cited by examiner

*Primary Examiner*—David A. Simmons
*Assistant Examiner*—Minh-/Chau T. Pham
(74) *Attorney, Agent, or Firm*—Robert O. Rice; Stephen D. Krefman; Thomas J. Roth

(57) ABSTRACT

An air treatment appliance having an external body with a movable portion and a main portion. An air inlet and an air outlet in the external body permit airflow through the device. A fan inside the body is operable to draw in air through the air inlet and to expel it through the air outlet, and the air may be passed through a filter mechanism in the device. An access mechanism permits convenient access to the filter mechanism and other components in the external body. The device is at least partially disabled when the movable portion is moved relative to the main portion.

6 Claims, 8 Drawing Sheets

ACCESS APPARATUS FOR AN AIR TREATMENT APPLIANCE

BACKGROUND OF THE INVENTION

This invention relates generally to air treatment appliances such as air purifying devices and, more particularly, to an access apparatus for conveniently accessing a filtering mechanism and other components inside an air treatment appliance.

Air treatment appliances are known in the art. The appliances typically include air purifiers which have an air inlet for air to be drawn into the device, a fan for drawing in the air, a filtering mechanism to filter out undesirable material from the air drawn in, such as contaminants, dust particles and other debris, and an air outlet for expelling the filtered air. The devices typically also contain other associated components, such as electrical switches and electrical or electronic circuitry for controlling and monitoring the operation of the device. Over time, undesirable material filtered out by the filtering mechanism in such devices accumulates in the filtering mechanism, whereby the filtering mechanism gets loaded with undesirable material. Accordingly, the filtering mechanism in these devices must either be cleaned, or sometimes replaced, from time-to-time, in order to remove the accumulated undesirable material. If, however, the filtering mechanism is not cleaned or replaced when necessary, the performance of the device is detrimentally impacted and the quality of the air filtered by the device deteriorates. This can be harmful for a user, particularly for users with health problems who use the device for health reasons. Further, a loaded filtering mechanism puts an excess strain on the fan to draw in air, or the capacity of airflow can decrease. Therefore, it is important to clean or replace the filtering mechanism in an air purifying device as and when necessary, which requires knowing when the filtering mechanism inside the device needs cleaning or replacement.

Typically, an air purifying device has to be opened in order to inspect the filtering mechanism within it. The opening procedure for opening known devices, however, can be cumbersome and tedious, including restoring the device back to its proper closed operating position afterwards. Depending upon the difficulty of the task, users tend to procrastinate in performing timely inspections and/or cleanings of the filtering mechanism in such devices. This results in delayed cleaning or replacement of the filtering mechanism, which detrimentally impacts the performance of the device and deteriorates the quality of the air filtered by the device.

In order to prevent such problems, some users may tend to clean or replace the filtering mechanism in the devices more frequently than necessary, such as each time the device is opened to inspect the filtering mechanism inside. Others may tend to do so at fixed predetermined time intervals, irrespective of whether or not the mechanism needs cleaning or replacement. Although this helps maintain the performance of the device and the quality of air filtered by it, it results in an unnecessary waste of both time and money.

Known air purifying devices typically also include at least one moving part inside the device, which is usually a fan for drawing in air through the filtering mechanism and expelling it from the device in a predetermined direction. Such moving parts tend to accumulate dust and debris over time due to the high traffic of air that they are exposed to, which may decrease the efficiency of the overall device. Such condition, however, is not readily apparent to a user until having had a chance to visually inspect the interior of the device when the device is opened. Typically, however, as discussed above such devices may not be opened all that frequently depending upon the complexity of the opening procedure, whereby such undesirable condition may continue to exist undetected.

Some known devices have another drawback in that they may be opened and operated simultaneously, which creates a hazardous situation for the user and other people, children or pets in the vicinity of the device because of the presence of usually at least one moving part in the device. Other devices that provide a mechanism designed to prevent operation while the device is open are usually not failsafe as a user may manually override the mechanism or somehow relatively easily defeat the mechanism for preventing operation of the device while it is open, whereby a hazardous situation may be created. In other devices, the mechanism may be defeated unintentionally whereby the device remains operable even though it is not fully or properly closed, once again creating a hazardous situation.

Other appliances, particularly air treatment appliances such as air conditioners, humidifiers, dehumidifiers, and the like, have similar constructions to those of air purifiers, and typically share at least some of the same drawbacks as discussed above.

There is, therefore, a need for an improved air purifying device or other appliance wherein a user may conveniently open the device to inspect or access the filtering mechanism and/or the moving parts within the device, which has a relatively failsafe mechanism to prevent operation of the device while the device is open or not properly closed. Accordingly, this invention is directed to overcoming one or more of the problems set forth above.

SUMMARY

An air purifying device or other air treatment appliance includes a body, an air inlet for permitting air to be drawn into the device, a fan for drawing the air into the device, possibly a filtering mechanism to filter out undesirable material from the air drawn into the device, and an air outlet for permitting the filtered air to be expelled from the device. At least a portion of the body is movable or separable from the main portion of the body. Two convenient access pads on the body allow the movable portion of the body to be released from the main portion of the body. A pair of switches positioned in the body exert a force on the movable portion of the body whereby it is moved relative to the main portion of the body when the access pads are actuated. The release of the movable portion of the body opens the pair of switches, whereby the device is rendered at least partially non-operational. The movable portion must be returned to its operable position with the main portion of the body whereby both of the pair of switches are closed to ensure that the device is closed properly for the device to be fully operational again.

DETAILED DESCRIPTION OF THE PREFERRED EMBODIMENT

The present invention is useful in a wide variety of appliances, particularly air treatment appliances with one or more internal components which have a condition capable of changing during operation of the appliance. One such appliance in which the invention finds utility is an air purifying device. It is this appliance in which the invention will be described, although it should be understood that the invention is not limited to this particular appliance.

Figure 1:
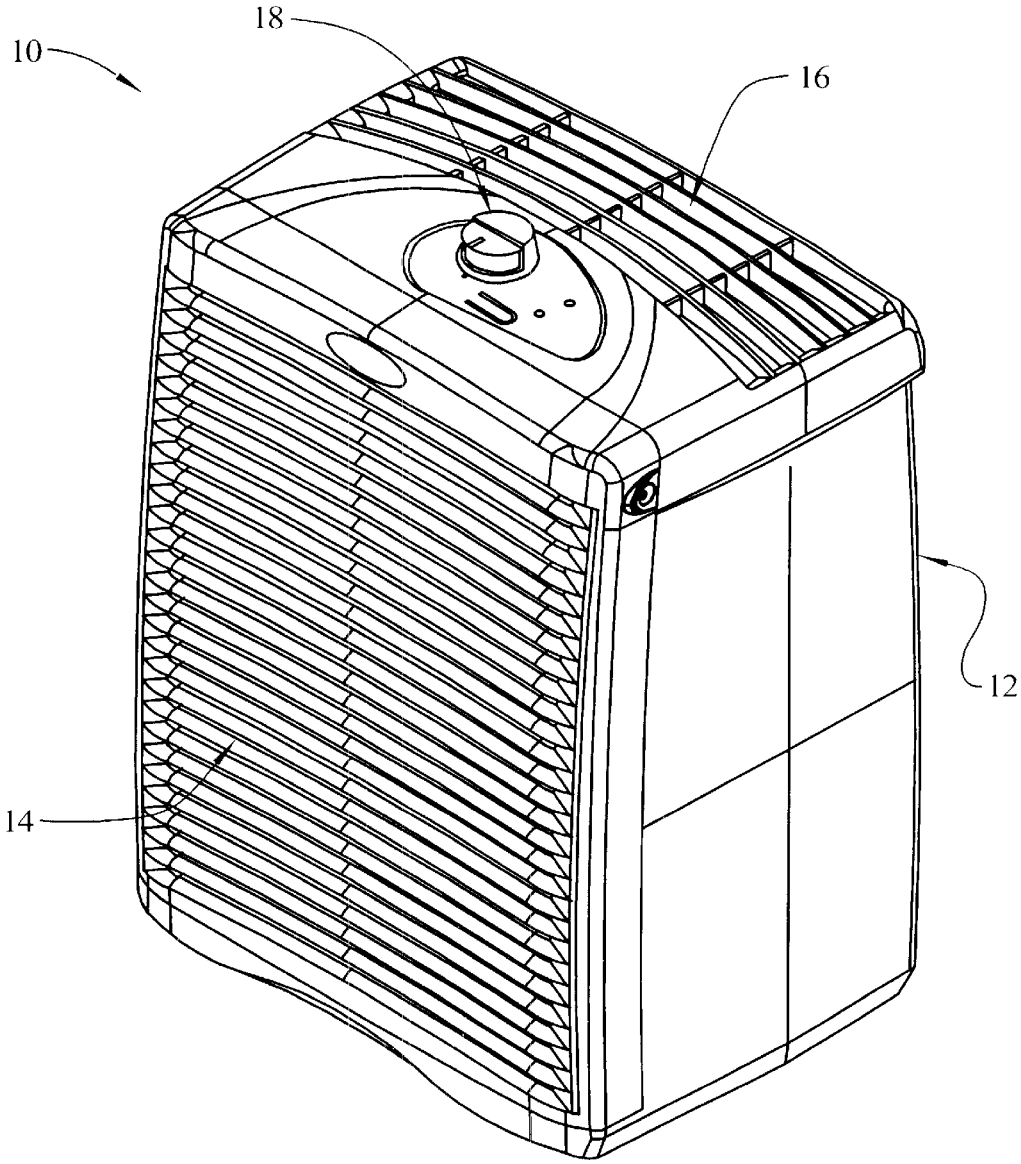
FIG. 1 is a perspective view of the exterior of an air purifying device with its body in a closed position according to one embodiment of the present invention.

Referring to FIG. 1, the exterior of an air purifying device 10 with its body in a closed position according to one embodiment of the present invention is shown. The device 10 includes an exterior body 12 which houses the internal components (discussed below) of the device 10. The body 12 will usually be comprised of two or more portions operatively connected together (also discussed below), which portions may be disconnected from each other at least partially, or even removed altogether, to provide access to the interior of the device. The body 12 will typically also include other functional features such as an air inlet 14 and an air outlet 16 which are discussed in greater detail below.

The device 10 also includes an electrical control means 18, such as an electrical switch, a control knob, or the like, for at least partially controlling the operation of the device. It is recognized and anticipated that any electrical or electronic control apparatus known in the art that is usable with air purifying devices may be used in the device 10. In other embodiments, it is recognized that the electrical control means 18 may be eliminated altogether. However, it is anticipated that the electrical control means 18 will typically include at least a power switch for switching the device 10 on or off. The electrical control means 18 may also include additional components such as a user selectable speed control mechanism for selectively controlling the speed of operation of the device 10, a corresponding visual indicator such as a light or an LED indicative of the selected speed of operation, and the like. Accordingly, all such variations and embodiments of the electrical control means 18 are recognized and anticipated, and therefore it is intended that the claims shall cover all such embodiments that do not depart from the spirit and scope of the present invention.

Air inlet means 14 typically provides an inlet for the surrounding air to be drawn into the air purifying device 10. In this regard, the air inlet means 14 will provide an opening in the body 12. Typically, the air inlet means 14 will include a grille or fins with openings inbetween of a predetermined width. The grille or fins serve to prevent any large objects from being undesirably drawn into the device 10 along with the air being drawn in, which may damage the device or inflict injury upon a person or a pet, etc., in the vicinity of the device. In other embodiments, however, the device 10 may have a wire mesh or wider-sectioned openings to serve as the air inlet means 14. The air inlet means 14 may also comprise a series of spaced openings through an otherwise planar or curved surface of the body 12. Accordingly, all such variations and embodiments are recognized and anticipated.

Similarly, the body 10 includes an air outlet means 16 for expelling the air that is drawn into the device through the air inlet means 14, whereby the air outlet means 16 will also provide an opening in the body 12. In this regard, the air outlet means 16 will typically be spaced apart from the air inlet means 14. Typically, the air outlet means 16 will also include a grille or fins with openings inbetween of a predetermined width. In other embodiments, however, the device 10 may have a wire mesh or wider-sectioned openings to serve as the air outlet means 16. The air outlet means 16 may also comprise a series of spaced openings through an otherwise planar or curved surface of the body 12. Accordingly, all such embodiments are recognized and anticipated. It is, however, noted that the construction of the air outlet means 16 in a particular embodiment of the device 10 does not have to identically match the construction of the air inlet means 14 in that same embodiment. The construction of each of the air inlet means 14 and the air outlet means 16 may be similar or they may be different, and it is recognized that the construction thereof will typically vary from one embodiment to another.

Figure 2:
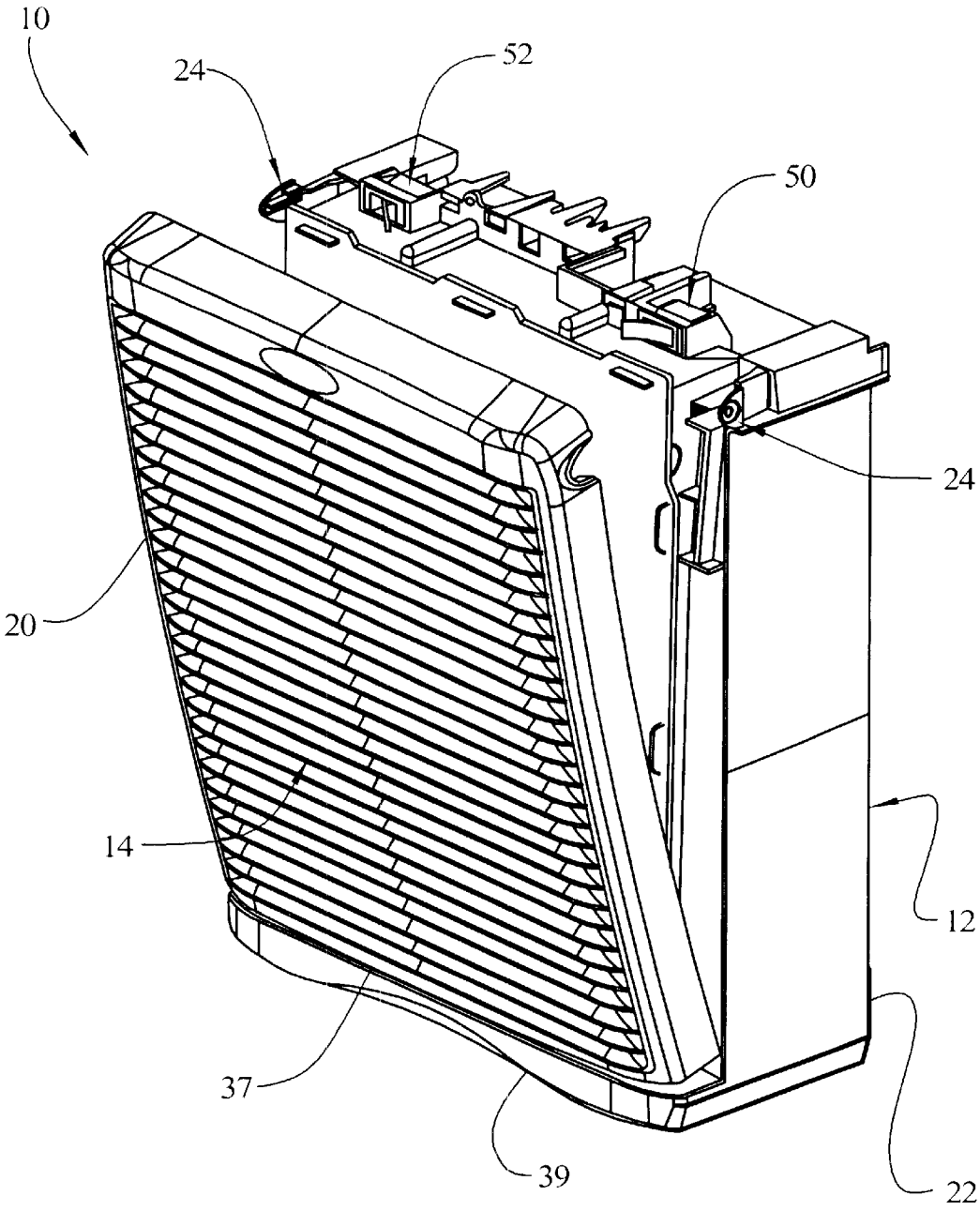
FIG. 2 is a perspective view of a portion of the air purifying device of FIG. 1, wherein a movable portion of the body of the device is shown moved relative to the main portion of the body.

Referring to FIG. 2, the body 12 has a main portion 22 and a movable portion 20 which is movable relative thereto. It is recognized and anticipated, however, that the body 12 may have more movable portions in addition to movable portion 20 in other embodiments of the present invention. Such portions of the body 12 are operatively connected together in any manner known in the art, such as by screws, by snapping together corresponding portions integrally constructed in the pieces of the body 12, and the like. In one embodiment, movable portion 20 and the main portion 22 of the body 12 are operatively connected together by a convenient actuator pad mechanism 24 described below.

Figure 3:
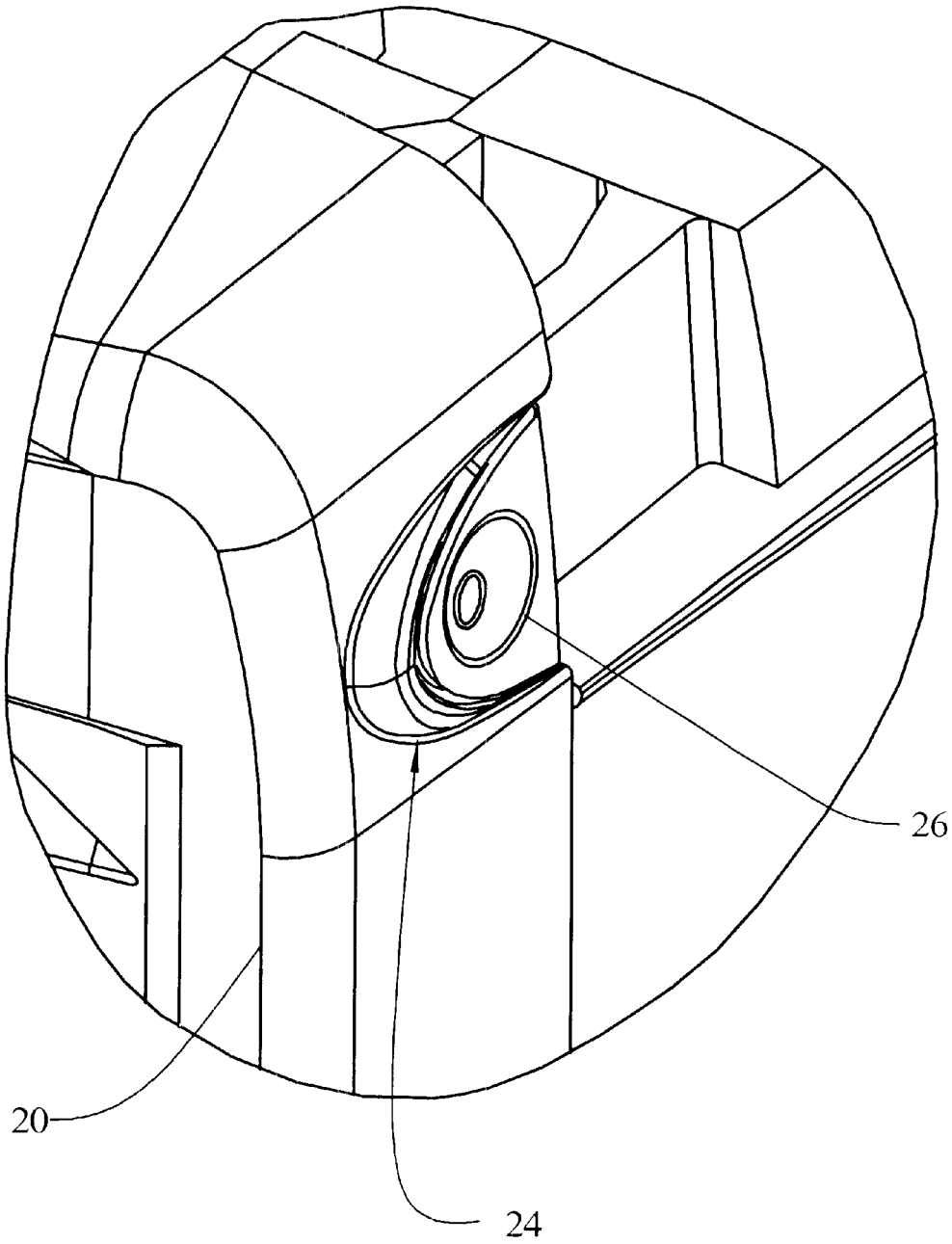
FIG. 3 is an enlarged view of an actuator pad mechanism on the body of the device of FIGS. 1 and 2 which is actuatable for releasing the movable portion of the body from the main portion of the body.

Referring to FIG. 3, an enlarged view of an actuator pad mechanism 24 on the body 12 of the device 10 is shown. The actuator pad mechanism 24 is actuatable for releasing at least a portion of the movable portion 20 of the body 12 from the main portion 22. There may, however, be more than one actuator pad mechanism 24 in the device 10 in other embodiments, and there are two actuator pad mechanisms 24 positioned on opposite sides of the device 10 in the preferred embodiment of the present invention. The actuator pad mechanism 24 includes corresponding parts in both of the movable portion 20 and the main portion 22 of the body 12. These parts cooperatively engage with each other for securing together the movable portion 20 with the main portion 22 to close the device 10. The actuator mechanism 24 preferably includes a physical formation therein, such as a depressed concave section 26, for a user's convenience in actuating the actuator pad mechanism 24, and even in locating the actuator pad mechanism 24 just by feeling the surface of the body 12 with the user's hands. In another embodiment, the depressed concave section 26 also includes a fingertip piece 28 for further convenience of a user whereby the user may also conveniently actuate the actuator pad mechanism 24 with one finger.

Figure 4:
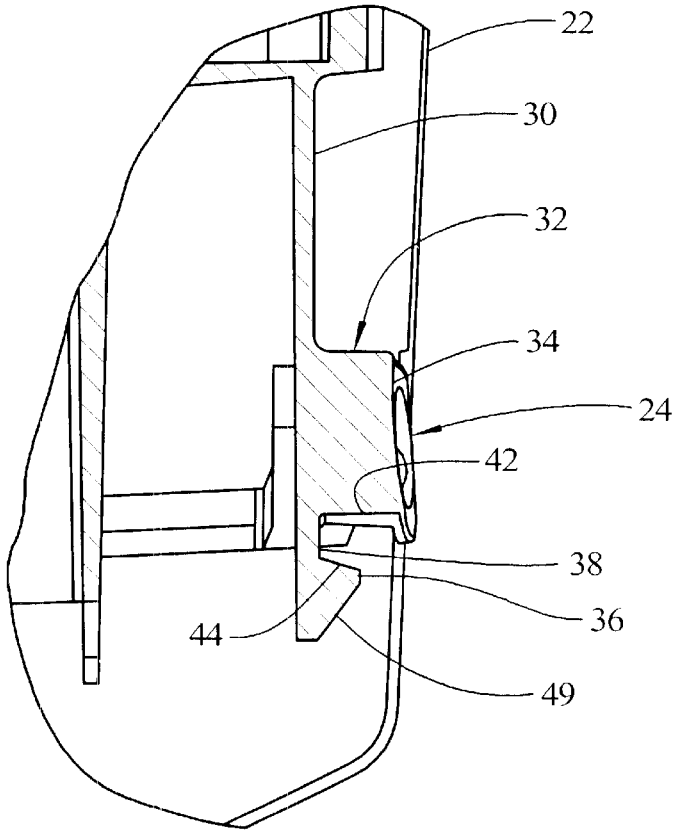
FIG. 4 is a top sectional view of the interior of the main portion of the body of the device of FIGS. 1 and 2 when the movable portion of the body is released from the main portion of the body, showing the parts on the main portion of the body that are cooperatively engagable with corresponding parts on the movable portion of the body.
Figure 5:
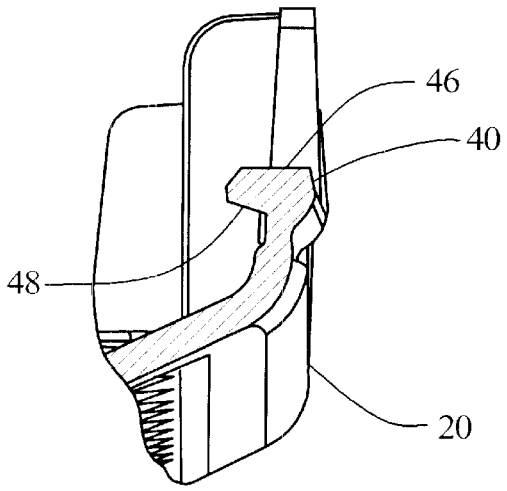
FIG. 5 is a top sectional view of the interior of the movable portion of the body of the device of FIGS. 1 and 2 when the movable portion of the body is released from the main portion of the body, showing the parts on the movable portion of the body that cooperatively engage with corresponding parts on the main portion of the body shown in FIG. 4.
Figure 6:
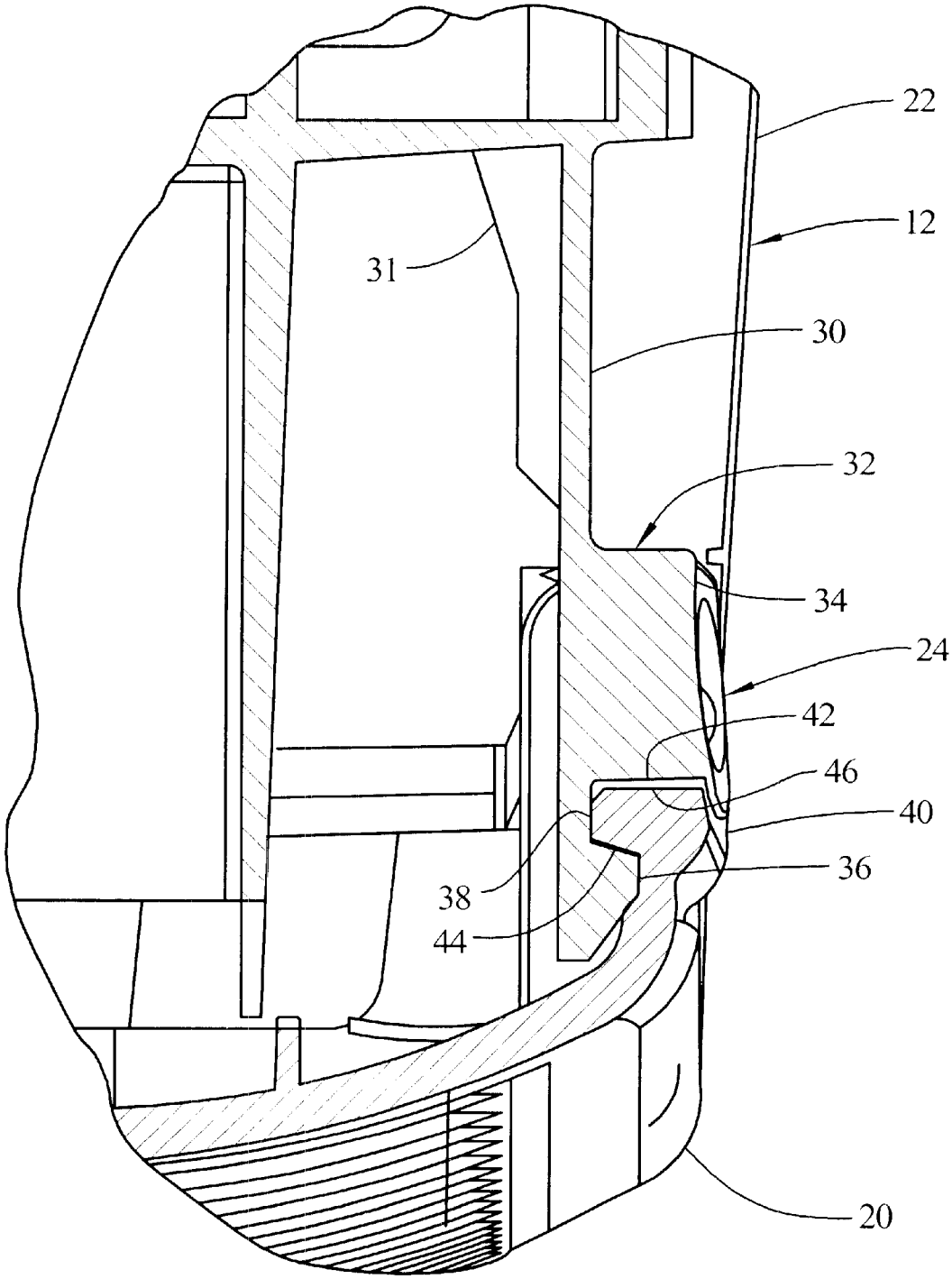
FIG. 6 is a top sectional view of the interior of the body of the device of FIGS. 1 and 2 with the movable portion of the body cooperatively engaged with the main portion of the body, showing the cooperative engagement of corresponding parts of the movable portion of the body and the main portion of the body.

The construction and operation of the actuator pad mechanism 24 according to one embodiment of the present invention is depicted in greater detail in FIGS. 4 through 6. Referring to FIG. 4 through 6, a top sectional view of a portion of the interior of the body of the device 10 is shown with corresponding parts of the movable portion 20 and the main portion 22 that are cooperatively engagable with each other. (Device 10 is closed as shown in FIG. 6.) Referring to FIG. 4, the actuating pad mechanism 24 includes a finger 30 connected to the main portion 22 of the body 12. The finger 30 may be constructed either integrally with the main portion 22, or it may be attached to the main portion 22 by any attaching means used in the art, such as a screw, an adhesive, or the like. Connected to the finger 30 is a latch member 32, which may either be constructed integrally with the finger 30, or it may be attached to the finger 30 by any attaching means used in the art, such as a screw, an adhesive, or the like. It may be appreciated that the finger 30 provides flexibility, although limited flexibility only, to the latch member 32.

In the embodiment shown in FIGS. 4 through 6, the latch member 32 comprises a button 34 and a tongue 36 with a groove 38 inbetween the button 34 and the tongue 36. In one embodiment, the depressed concave section 26 is constructed integrally in the latch member 32, more particularly in the button 34. The design and construction of the button 34, the tongue 36, and the groove 38 inbetween them, serve to cooperatively engage with corresponding parts in the movable portion 20 of the body 12.

Referring to FIG. 5, a top sectional view of a portion of the interior of the movable portion 20 of the body 12 is shown with the parts thereon that cooperatively engage with corresponding parts on the main portion 22 of the body. As shown, a hook 40 is substantially rigidly connected to the movable portion 20. It is recognized and anticipated that the hook 40 may be integrally constructed with the movable portion 20, or it may be substantially rigidly attached thereto in any manner known in the art, such as by a screw, by an adhesive, by snapping together corresponding parts integrally constructed therein, and the like.

Referring to FIG. 6, a top sectional view of a portion of the interior of the body 12 of the device 10 is shown with parts in the movable portion 20 cooperatively engaged with corresponding parts in the main portion 22 of the body 12. Accordingly, FIG. 6 depicts the cooperative engagement of the corresponding parts of the movable portion 20 and the main portion 22 of the body 12 of the device 10. As shown, the hook 40 fits into the groove 38, and is held in place by walls 42 and 44 of the button 34 and the tongue 36, respectively, abutting against walls 46 and 48, respectively, of the hook 40. Those skilled in the art will appreciate that with such a configuration, the movable portion 20 will be held substantially rigidly with the main portion 22 of the body 12 when the corresponding parts are cooperatively engaged with each other as shown in FIG. 6. Accordingly, when the parts are thus cooperatively engaged with each other, the device 10 will be closed, and access to the interior of the device 10 will be substantially restricted.

When a user desires to release the movable portion 20 from the main portion 22 of the body 12 when the device 10 is closed, he may selectively actuate the actuator pad mechanism 24. This will typically entail pushing the button 34, such as pushing the depressed concave section 26. Pushing the button 34 will result in pressure upon the latch member 32 towards the interior of the device 10. As a result, the latch member 32 will be deflected inwards at finger 30, whereby the wall 44 of the tongue 36 will slide along the wall 48 of the hook 40. Upon application of adequate pressure upon the button 34, the wall 44 will slide along the wall 48 far enough for the latch member 32 to be released from the hook 40 of the movable portion 20. At that point, it will be appreciated that the movable portion 20 will be released from the main portion 22 of the body 12, whereby the movable portion may be moved from the main portion 22 either manually by the user, or the movable portion 20 may be moved away from the main portion 22 automatically, in an alternate embodiment, by a mechanism such as a tension spring, a lever, a paddle, or the like. One such alternate embodiment is discussed in greater detail below.

The amount of flexibility of the latch member 32 as a function of the amount of force applied on the button 34 will typically depend upon the thickness of the finger 30 and the thickness of a stiffening rib 31 associated therewith. The stiffening rib 31, as shown, provides support for the finger 30 when the actuator pad mechanism 24 is actuated or the button 34 is pushed. Accordingly, the thickness of the finger 30 and the stiffening rib 31 may be customized in each embodiment of the present invention in accordance with the material that it is constructed of and the minimum amount of force desired upon button 34 for releasing the movable portion 20. It is, however, recognized that the thickness of the finger 30 and the stiffening rib 31 should be adequate to prevent the latch member 32 from breaking off at finger 30 due to repeated use of the actuator pad mechanism 34 and reasonable force applied upon the button 34. Further, in one embodiment a mechanism, such as a wall attached with the body 12 at a predetermined distance from the latch member 32, may be provided to prevent the latch member 32 from being pushed any further than necessary to release the movable portion 20. It will be appreciated that such mechanism will help prevent the latch member 32 from being pushed too far which may cause the latch member 32 to break at finger 30. It will be further appreciated that such mechanism will supplement the stiffening rib 31 to help prevent the latch member 32 from breaking at finger 30.

The embodiment of the device 10 depicted in FIGS. 1 and 2, has two sets of the actuator pad mechanism 24, one on each side of the device 10. Accordingly, a user would have to essentially simultaneously actuate both actuator pad mechanisms 24 to release the movable portion 20 of the body 12 from the main portion 22. It will be appreciated that having two actuator pad mechanisms 24 will help prevent an accidental release of the movable portion 20 from the main portion 22 of the body 12 if one actuator pad mechanism 24 is pressed accidentally. Further, two actuator pad mechanisms 24 include two latch members 32 to retain the movable portion 20 with the main portion 22 of the body 12, thereby providing a sturdier fit together of the two portions. However, it is recognized and anticipated that other embodiments of the present invention may have only one actuator pad mechanism 24, or they may have more than two actuator pad mechanisms 24, and therefore it is intended that the claims shall cover all such embodiments that do not depart from the spirit and scope of the present invention.

Referring again to FIGS. 4 through 6, the design of the tongue 36 serves another important purpose in facilitating convenient closing of the device 10. One side of the tongue 36 is designed with an angular outer edge 49 as shown in FIG. 4. When a user desires to close the device 10, such as after inspecting, cleaning or replacing the filter mechanism inside the device 10, he will typically bring the movable portion 20 together with the main portion 22 of the body 12. During the closing process, it is anticipated that one side 37 (FIG. 2) of the movable portion 20 will mate with a corresponding part 39 on the main portion 22 of the body 12. This mating of the body's 12 components may be implemented in any way known therefor in the art, such as by a hinge or by one or more stubs on one portion mating with corresponding stubs or holes on the other portion of the body 12. It will be appreciated that providing such a mating feature is not essential for practicing the present invention, but such a feature will facilitate proper closure of the device 10, including properly aligning the corresponding parts and portions of the body 12. Accordingly, when the side 37 of the movable portion 20 is aligned with the corresponding part 39 on the main portion 22, the top edge of the movable portion will be able to swivel towards the corresponding top edge on the main portion 20.

These top parts include corresponding parts of the actuator pad mechanism 24 as discussed herein above. As the hook 46 of the actuator pad mechanism 24, which is substantially fixedly attached to the movable portion 22 (FIG. 5), approaches the corresponding parts of the actuator pad mechanism 24 in the main portion 22 during closing of the device 10, the hook 46 will come in contact with the angular outer edge 49 of the tongue 36. When the movable portion 20 is pushed in further towards the main portion 20, the hook 46 will apply a force upon the outer angular edge 49 of the tongue 36. This force will cause the tongue member, and therefore the remaining portions of the latch member 32, to be pushed inwards. Therefore, as the movable portion 20 is brought in closer towards the main portion 20, the latch member 32, and therefore the actuator pad mechanism 24, will be automatically pushed inwards incrementally, similarly as is done manually by a user when pushing the button 34 to open the device 10. As discussed previously, the actuator pad mechanism 24 flexes at the finger 30, which allows movement of the latch member 32. When the movable portion 20 is pushed adequately towards the main portion 22, the hook 46 will move past the tongue member 36, whereby the hook will enter the groove 38, and the wall 48 of the hook 46 will abut against the wall 44 of the tongue member 36, whereby the parts will be cooperatively engaged with each other. In this position, the device 10 will be closed. Accordingly, a user may conveniently close the device 10 by simply pushing the movable portion 20 towards the main portion 22. This feature of convenient closing of the device 10 shall function similarly irrespective of the number of actuator pad mechanisms 24 in other embodiments of the present invention.

Figure 7:
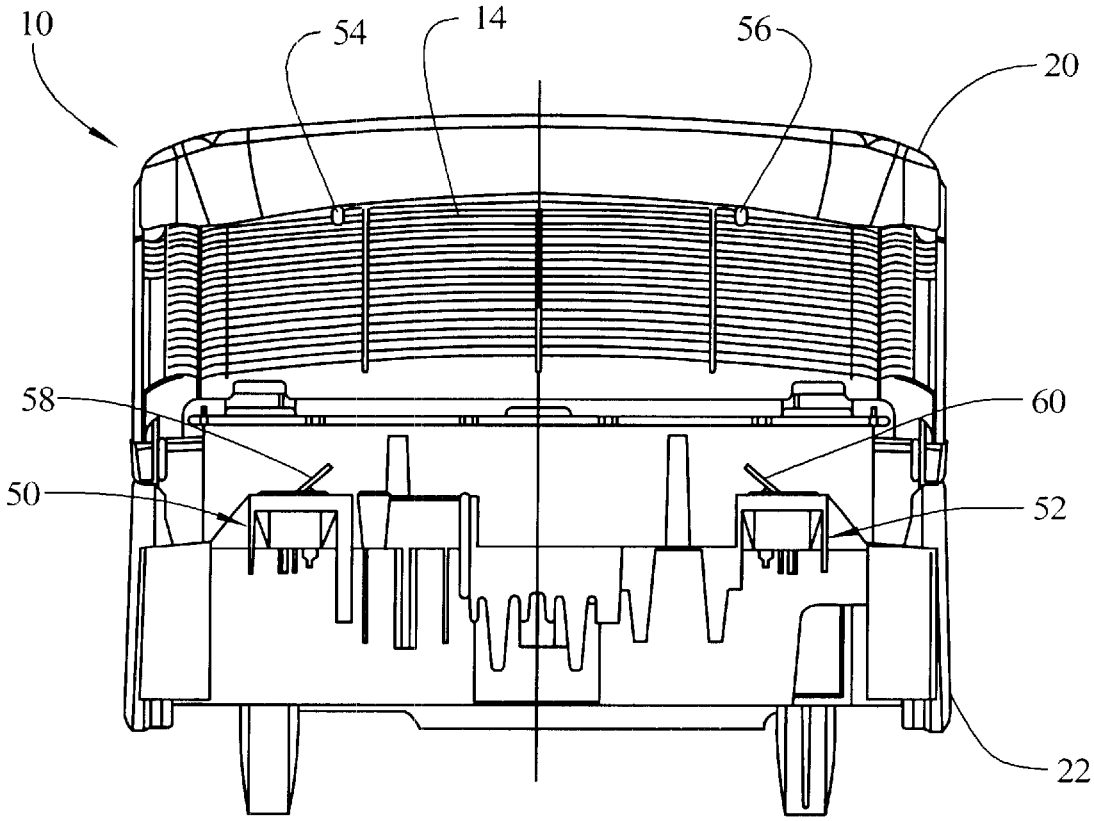
FIG. 7 is a top plan view of the device of FIGS. 1 and 2 corresponding to the position of the device depicted in FIG. 2, showing a pair of switches in the main portion of the body and a pair of posts corresponding thereto on the movable portion of the body.

Referring to FIG. 7, a top plan view of the device 10 corresponding to the position of the device 10 depicted in FIG. 2 is shown. As shown, the movable portion 20 is partially moved, or separated, from the main portion 22 of the body 12, whereby the device 10 is open. The interior of the air inlet 14 in the movable portion 20 is also partially visible in the figure. More particularly, however, FIG. 7 shows a pair of switches 50 and 52 in the main portion 22 of the body 12 and a pair of posts 54 and 56 corresponding respectively thereto in the movable portion 20 of the body 12. The switches 50 and 52 engage with the posts 54 and 56 when the device 10 is closed, which is discussed in greater detail below.

The switches 50 and 52 in one embodiment of the present invention are recessed paddle actuated rocker switches. Recessed paddle actuated rocker switches are operable to be in an electrically closed position when a corresponding actuating device, such as a post or a stub, etc., presses against or actuates a paddle mechanism in the respective switch. The paddle mechanism is typically a pivotable lever that the actuating device comes in contact with and actuates by applying a force thereupon. When the switch is thus actuated, the lever is pressed whereby it pivots, and two electrical contacts in the switch come in electrical contact with each other thereby completing an electrical circuit and therefore electrically closing the switch. In the absence of actuation, however, the pivotable lever is not pushed and the electrical contacts in the switch remain separated from each other, and therefore the switch remains in an electrically open position. However, it is recognized and anticipated that other types of switches used in the art for similar purposes may be used instead of the recessed paddle actuated rocker switches 50 and 52 without departing from the spirit and scope of the present invention.

Figure 8:
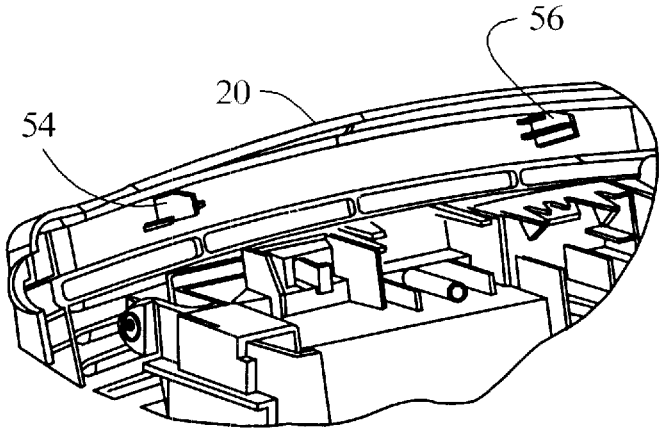
FIG. 8 is a perspective elevational view of the interior of the movable portion of the body of the device of FIGS. 1 and 2 after releasing the movable portion from the main portion of the body, showing the pair of posts in the movable portion of the body that correspond to the pair of switches in the main portion of the body.

Referring to FIG. 8, a perspective plan view of the interior back side of the movable portion 20 of the body 12 is shown released from the main portion 22, showing the pair of posts 54 and 56 thereon. As mentioned, the posts 54 and 56 correspond to the pair of switches 50 and 52 respectively in the main portion 22 of the body 12. When the device 10 is opened, i.e., the movable portion 20 is moved relative to the main portion 22, the posts 54 and 56 are separated from the switches 50 and 52. In such event, the posts are not in physical contact with the switches anymore. (In FIG. 7, The posts 54 and 56 are shown separated from the switches 50 and 52 when the device 10 is opened.) Thus separated from the posts 54 and 56, the switches 50 and 52 are electrically open and therefore the device 10 is rendered at least partially non-operational, such as by disabling electrical power to one or more components of the electrical control means 18. It is recognized and anticipated that the device 10 may be rendered at least partially non-operational by disabling electrical power to some particular components in the device 10, such as an air moving device 19 and other moving parts. In other embodiments, however, the device 10 may be rendered non-operational by disabling electrical power to all components in the device 10, thereby rendering the entire device 10 non-operational. It is recognized that the device 10 will be rendered non-operational as soon as the posts 54 and 56 leave physical contact with the switches 50 and 52, irrespective of whether the device 10 was in operation or was idle when the device 10 was opened. More particularly, it is desirable that the device be rendered at least partially non-operational relatively immediately when the movable portion 20 is moved relative to the main portion 22, and that the device 10 remain so until the movable portion 20 is properly replaced relative to the main portion 22 and the device 10 is closed. Therefore, if the device 10 is in operation when the posts 54 and 56 leave contact with the paddles 58 and 60 on the switches 50 and 52, then the electrical supply to components of the device 10 is interrupted because the switches 50 and 52 are electrically open, whereby the device 10 is rendered non-operational. On the other hand, if the device 10 is not is operation when the posts leave contact with the paddles 58 and 60, then the electrical supply to components of the device 10 is disabled because the switches 50 and 52 are open, and therefore the device 10 remains non-operational at least partially until the movable portion 20 is replaced whereby the paddles 58 and 60 are once again pushed by the posts 54 and 56, and therefore switches 50 and 52 are electrically closed. Accordingly, the posts 54 and 56 on the movable portion 20 of the body 12 must be pushing the paddles 58 and 60 for the device 10 to be fully operational.

It is preferred that the device 10 be rendered non-operational if any one of the switches is open. Accordingly, in the embodiment depicted in FIG. 8, it will be necessary for both of the posts 54 and 56 to press both of the paddles 58 and 60 whereby both of the switches 50 and 52 must be electrically closed in order for the device 10 to be operational. Therefore, in the event that the movable portion 20 is only partially closed with respect to the main portion 22, or if the movable portion is improperly closed with respect to the main portion 22, the device 10 will be at least partially non-operational. It will be appreciated that this feature will help ensure that the device 10 is fully and properly closed during operation, thereby considerably reducing the existence of a potentially hazardous situation associated with the device 10.

Figure 9:
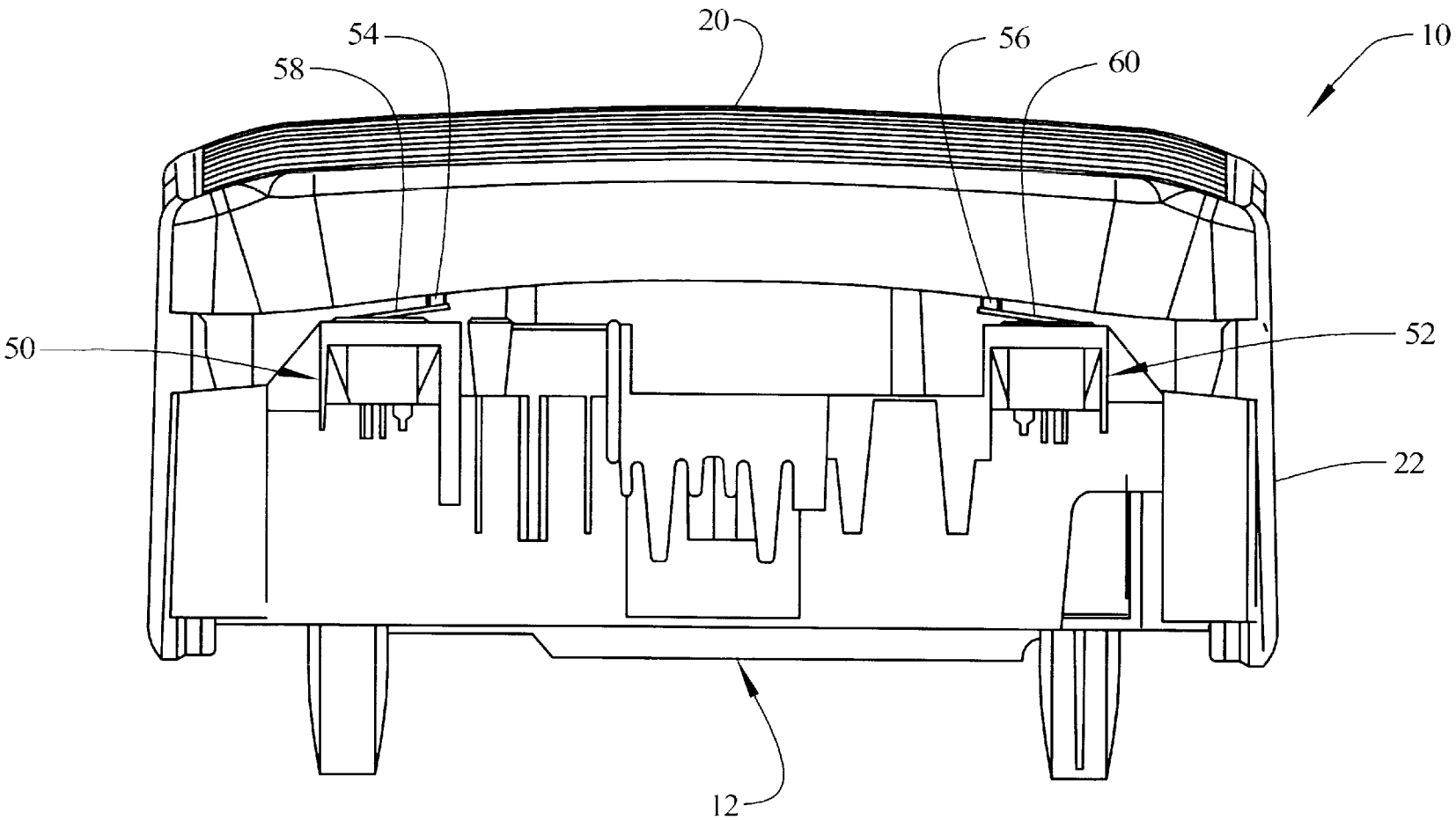
FIG. 9 is a top plan view of a portion of the device of FIGS. 1 and 2 showing the device in a closed position with the pair of posts on the movable portion of the body engaged with the pair of switches in the main portion of the body.

Referring to FIG. 9, a top sectional view of the device 10 is shown. The figure shows the pair of posts 54, 56 on the movable portion 20 of the body 12 of the device 10 engaged with the pair of switches 50 and 52 in the main portion 22 of the body 12 of the device 10. As shown, the paddles 58 and 60 are pushed in by the corresponding posts 54 and 56 respectively, whereby the switches 50 and 52 are electrically closed. It will be appreciated that the movable portion 20 must be closed properly with respect to the main portion 22 in order for the paddles 58 and 60 to be pushed properly, whereby the switches 50 and 52 will be closed and the device 10 will be fully operational.

The particular design of the posts 54 and 56, and the corresponding paddles 58 and 60, respectively, on switches 50 and 52, respectively, serves another beneficial function. It will be appreciated that when the device 10 is closed, i.e. when the movable portion 20 is closed with the main portion 22 of the body 12, the paddles 58 and 60 will push against the posts 54 and 56. This force will result in a constant outward force upon the movable portion 20 relative to the main portion 22 while the device 10 is closed. Accordingly, when the actuator pad mechanism 24 is actuated, the movable portion 20 will be automatically pushed away from the main portion 22 when the latch member 32, or the tongue member 36, is disengaged from the corresponding hook 40 in the movable portion 20 due to the automatic outward bias upon posts 54 and 56, i.e. upon the movable portion 20, by the paddles 58 and 60 in the main portion 22. As a result, the movable portion 20 will pop out automatically when the actuator mechanism 24 is actuated, and the user will not have to exert a separate force to release the movable portion 20 from the main portion 22 when selectively actuating the actuator pad mechanisms 24. Accordingly, the present design and construction provides this additional convenience in opening the device 10 in order to access the interior thereof. It will be appreciated that this feature will perform thusly for all switches and the entire device 10 irrespective of the actual number of actuator pad mechanisms 24 or switches implemented in a particular embodiment of the present invention.

Figure 10:
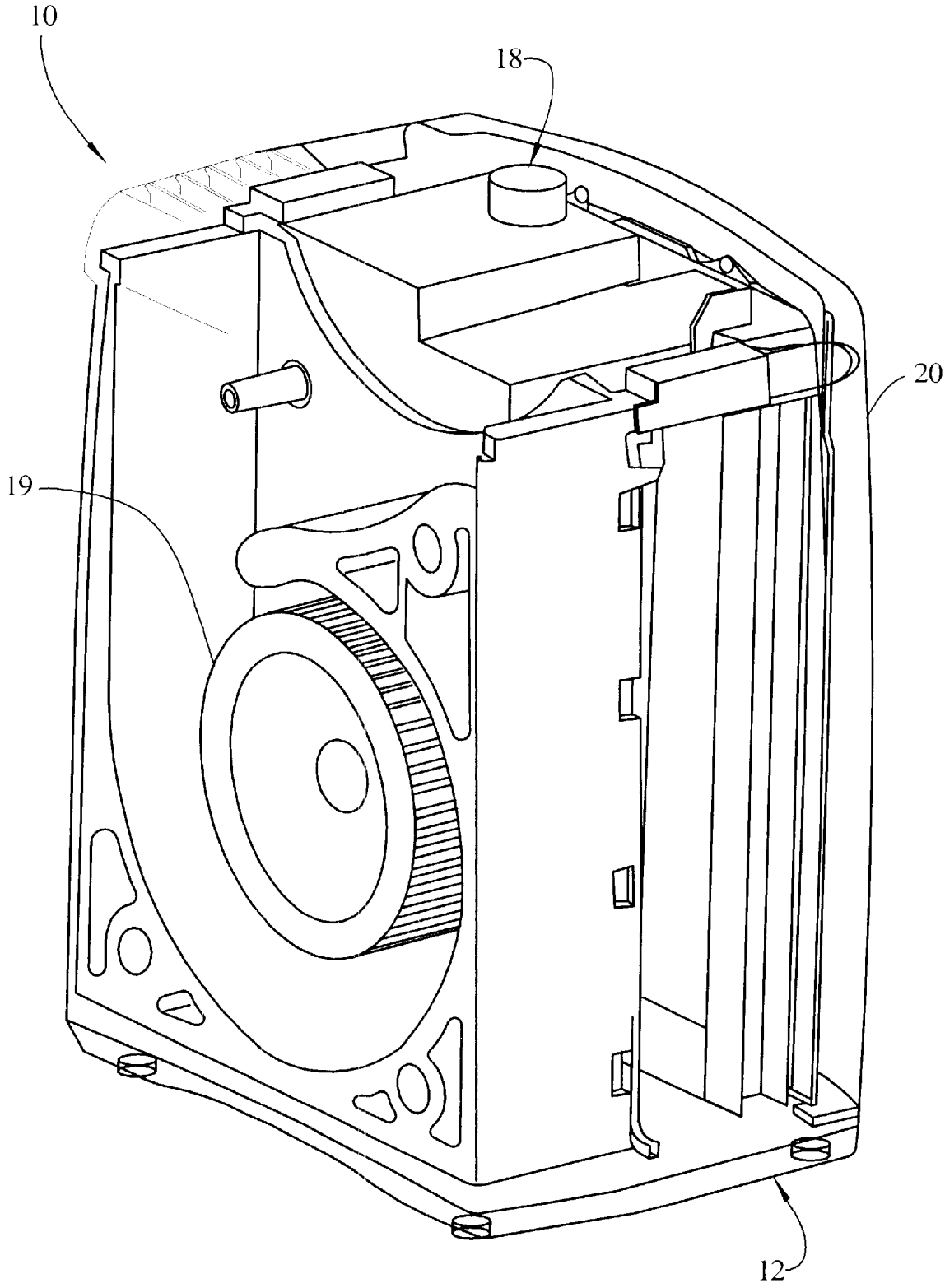
FIG. 10 is a rear perspective sectional view of the air purifying device of FIGS. 1 and 2, wherein the components within the device are partially visible.

Referring to FIG. 10, a rear perspective view partially showing the parts in the device 10 are shown. More particularly, an air moving device in the form of a fan 19 inside the device 10 is shown. As discussed herein above, the fan 19 is typically operable to draw in air through the air inlet means 14 (not shown in FIG. 10) and to expel it through the air outlet means 16.

It is recognized and anticipated that a different number of switches and corresponding posts may be implemented in different embodiments of the present invention. For example, one embodiment may have only one switch and a corresponding post, and that one switch must be closed for the device to be fully operational. In another embodiment, there may be four corresponding pairs of switches and posts, one at each of the four comers of the device 10, that must all be closed in order for the device 10 to be fully operational. It will be appreciated, however, that such an embodiment will have a lower likelihood of error that the switches may be all closed when the device is not fully or properly closed, which is because of the presence of a switch at each comer of the main portion 22 that must all be properly engaged.

In an alternate embodiment, the different switches may be associated with different operational components in the device 10. In such embodiment, only the components associated with switches that are open will be rendered non-operational while those switches are open. It will be appreciated that such embodiment will accommodate the situation wherein the movable portion 20 might be either partially or improperly closed with respect to the main portion 22. Accordingly, the association of the switches with the device's 10 components may be customized, and all such embodiments of the present invention are recognized and anticipated.

As is evident from the foregoing description, certain aspects of the present invention are not limited to the particular details of the examples illustrated herein, and it is therefore contemplated that other modifications and applications will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

The embodiments of the invention in which an exclusive property or privilege is claimed are defined as follows:

1. An air treatment appliance for treating surrounding air including:

an external body comprising a main portion and a movable portion;

an air inlet in said external body;

an air outlet in said external body;

an air moving device inside said external body, said air moving device being operable to draw in air through said air inlet, along an airflow path, and to expel it through said air outlet;

an air treatment mechanism inside said external body positioned in said airflow path; and an access mechanism in said external body operable to selectively allow movement of said movable portion with respect to said main portion comprising:

biasing means effective between said main portion and said movable portion to urge said movable portion away from said main portion;

first and second actuator pad mechanisms each including a button and a latch member carried on the main portion of the external body; and first and second hooks carried on the movable portion of the external body, wherein each said latch member cooperatively engages with a hook automatically when the movable portion of the external body is closed with the main portion of the external body, and each said latch member disengages from said hook when said button is pushed thereby allowing said biasing means to urge said movable portion away from said main portion.

2. The air treatment appliance of claim 1, wherein each latch member further includes a tongue having an angular outer edge, and each actuator pad mechanism further includes a finger, said finger flexing when said button is pushed to disengage said latch member from said hook.

3. The air treatment appliance of claim 1, further comprising an electrical control operable to at least partially control the operation of the appliance, and wherein said biasing means comprises:

at least one switch on the main portion of the external body; and at least one post on the movable portion of the external body corresponding to the at least one switch, wherein the at least one post is engagable with the at least one switch when the movable portion is closed with the main portion and operation of said appliance is at least partially enabled when said post is engaged with said at least one switch.

4. The air treatment appliance of claim 3, wherein the at least one switch is a recessed paddle actuated rocker switch, and wherein the at least one post pushes a paddle in the at least one switch when the movable portion is closed with the main portion, and the appliance is at least partially non-operational when the at least one post is not in contact with the paddle in the at least one switch.

5. The air treatment appliance of claim 3, wherein biasing means includes a plurality of switches on the main portion and a plurality of posts on the movable member corresponding to the plurality of switches, the plurality of posts being engagable with the plurality of switches when the movable portion is closed with the main portion.

6. A device for filtering out undesirable material from surrounding air, comprising:

an external body having a top and two sides and having a main portion and a movable portion being movable with respect to said main portion;

an air moving device in said external body;

an electrical control means operable to control an operation of said air moving device;

an air treatment mechanism in said external body;

a latch mechanism on said external body operable to selectively allow movement of said movable portion with respect to said main portion comprising:

an actuator pad mechanism including a button and a latch member carried on each side of the main portion of the external body; and a hook carried on each side of the movable portion of the external body, wherein said latch member cooperatively engages with the hook automatically when the movable portion of the external body is closed with the main portion of the external body, and said latch member disengages from said hook when said button is pushed to release said movable portion from said main portion; and biasing means effective between said main portion and said movable portion to urge said movable portion away from said main portion when said button is pushed, wherein said biasing means comprises:

two recessed paddle actuated rocker switches carried on said main portion of said external body; and two posts carried on said movable portion of said external body, each of said posts being cooperatively engagable with one of said paddle actuated rocker switches, wherein said electrical control means is at least partially disengaged when both of said posts are not cooperatively engaged with said paddle actuated rocker switches.

* * * * *